United States Patent [19]

Ritchie et al.

[11] 4,372,634

[45] Feb. 8, 1983

[54] TILT LATCH ZERO INSERTION FORCE CONNECTOR ASSEMBLY

[75] Inventors: Leon T. Ritchie, Mechanicsburg; Clair W. Snyder, Jr., York, both of Pa.; Thurston H. Toeppen, Poughkeepsie, N.Y.; John A. Woratyla, Camphill, Pa.

[73] Assignee: AMP Incorporated, Harrisburg, Pa.

[21] Appl. No.: 240,524

[22] Filed: Mar. 4, 1981

[51] Int. Cl.[3] ..... H01R 9/09

[52] U.S. Cl. ..... 339/17 C; 339/75 M; 339/91 R; 339/97 P; 339/206 R

[58] Field of Search ..... 339/17 C, 206, 207, 339/208, 210, 97 R, 97 P, 99 R, 75 M, 91 R

[56] References Cited

U.S. PATENT DOCUMENTS

| | | | |
|---|---|---|---|
| 3,363,224 | 1/1968 | Gluntz | 339/258 R |
| 3,858,960 | 1/1975 | Kunkle et al. | 339/206 R |
| 4,083,615 | 4/1978 | Volinskie | 339/99 R |
| 4,243,288 | 1/1981 | Lucius et al. | 339/99 R |
| 4,269,466 | 5/1981 | Huber | 339/97 R |
| 4,330,164 | 5/1982 | Pittman et al. | 339/99 R |

*Primary Examiner*—John McQuade
*Assistant Examiner*—Gary F. Paumen
*Attorney, Agent, or Firm*—Russell J. Egan

[57] ABSTRACT

A connector assembly is disclosed having both the capability of being mass terminated and for effecting zero insertion force mating with conductive holes of a printed circuit board or the like. The subject connector system includes a pair of identical housing members, each of which receives a plurality of terminals therein, and a pair of hermaphroditic cover members. Each housing member is an elongated member of insulative material having a mating face and a plurality of terminal receiving passages opening onto the mating face. The terminals each have a first end lying within the housing and capable of effecting mass termination of individual conductors by insulation displacing means and a second end extending from the mating face of the housing in resilient cantilever beam fashion. Each of the hermaphroditic/cover members encloses a respective one of the housing members to form a complete subassembly. Each subassembly is mated to a circuit board in a tilted condition with the resilient beams of the terminals extending into the conductive holes of the circuit board. The subassemblies are then rotated relative to each other to latch the cover members together while bringing the beams into contact with the side walls of the conductive holes thereby effecting contact therewith while securing the connector assembly in the printed circuit board.

8 Claims, 4 Drawing Figures

TILT LATCH ZERO INSERTION FORCE CONNECTOR ASSEMBLY

BACKGROUND OF THE INVENTION

1. The Field of the Invention

The present invention relates to a connector assembly formed by a pair of housings which are preloaded with terminals having a first mating insulation displacing end within the housings and a second resilient cantilever beam end extending from the housings and a pair of hermaphroditic cover members each of which forms a subassembly with a respective housing. The subassemblies are positioned in apertures in a printed circuit board in a tilted condition and rotated relative to each other to secure the subassemblies together bringing the beams into engagement with conductive holes in the printed circuit board.

2. The Prior Art

The present invention concerns a continuation of the product line of connector assemblies described in U.S. Pat. No. 4,243,288, the disclosure of which is incorporated herein by reference. The connector assembly of the noted patent provides means for efficient and cost productive mass termination of multiple conductors in a single operation. It does not provide for a zero insertion force engagement of the connector assembly and, in particular, for mating with conductive holes of a printed circuit board. In fact the terminals disclosed in this patent have a mating end of a pin receptacle type, disclosed in U.S. Pat. No. 3,363,224 with an insulation displacing conductor engaging opposite end of the type disclosed in U.S. patent application Ser. No. 927,720, filed July 25, 1978, now abandoned.

SUMMARY OF THE INVENTION

The present invention is intended to employ many of the principles described in the above-mentioned U.S. Pat. No. 4,243,288 to produce an electrical connector assembly having the advantages of both insulation displacement termination of multiple conductors and zero insertion force engagement of the connector with conductive holes of a printed circuit board or the like. The subject connector includes a pair of identical housing members, each having a mating face and a plurality of parallel spaced terminal passages opening onto the mating face. One side of each passage towards the rear of the passage is open providing access to a terminal positioned therein. Each terminal has an insulation displacing configuration lying in the open portion and a resilient cantilevered beam extending beyond the mating face. The connector also includes a pair of mating hermaphroditic cover members which enclose the rear surfaces of a respective housing member to form a subassembly. The covers also include legs which are passed through apertures in the circuit board, the beams extending into but not engaging the conductive holes. The subassemblies are then pivoted relative to each other and the circuit board to rotate the cover members into engagement and bring the beams of the terminals into engagement with the conductive holes in the printed circuit board.

It is therefore an object of the present invention to produce an improved electrical connector assembly which will provide the benefits of cost efficient mass termination of multiple conductors in a single operation as well as zero insertion force mating with a circuit board.

It is another object of the present invention to produce an improved electrical connector assembly utilizing insulation displacing terminals preloaded and partly exposed in respective housings with hermaphroditic covers providing a subassembly to both enclose the terminal carrying housings and to bring the terminals into engagement with walls of conductive holes in a printed circuit board or the like.

It is still another object of the present invention to produce a connector assembly which has pairs of housing members and related covers which are rotated in a subassembly to relocate beam portions of terminals carried by the housing members into engagement with conductive walls of holes in a printed circuit board of the like.

It is yet another object of the present invention to produce a connector assembly which is fully serviceable in that damaged terminals can be readily replaced.

It is a further object of the present invention to produce an improved electrical connector which can be readily and economically produced.

The means for accomplishing the foregoing objects and other advantages of the present invention will become apparent to those skilled in the art from the following detailed description taken with reference to the accompanying drawings.

DETAILED DESCRIPTION OF THE PREFERRED EMBODIMENT

Figure 1:
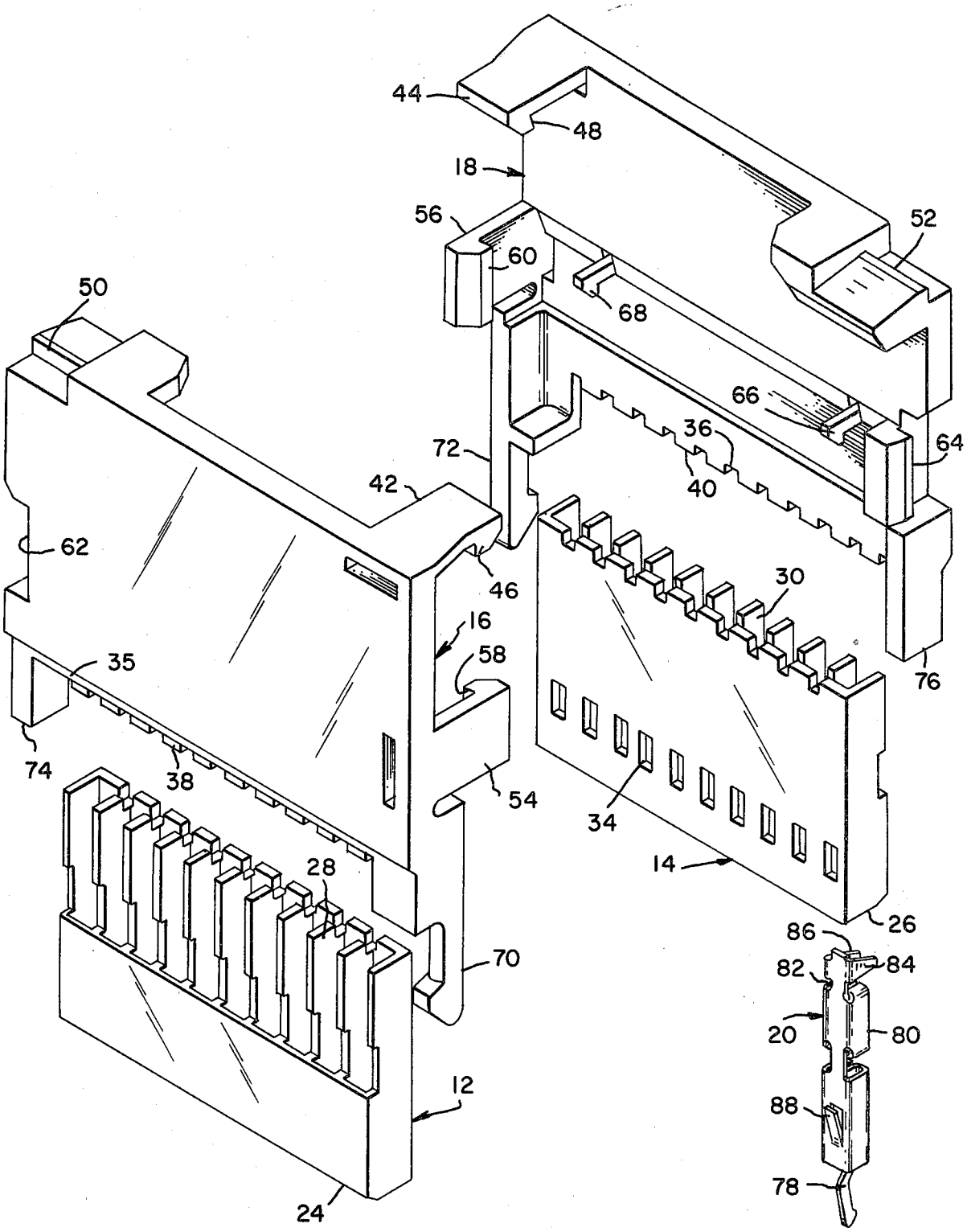
FIG. 1 is an exploded perspective view of the subject electrical connector assembly.

The subject electrical connector assembly 10 includes a pair of housing members 12, 14, a pair of mating hermaphroditic cover members 16, 18 and a plurality of electrical terminals 20 for terminating a like plurality of respective conductors 22. Each housing 12, 14 is an identical elongated member of rigid plastic material having a mating face 24, 26 with a plurality of terminal passages 28, 30 opening therein in an aligned spaced row of parallel passages. The sides of each housing are open at the rear end so that the passages 28, 30 are enclosed at their forward ends and are channel-shaped opening outwardly at their rear ends. The housings are each also provided with a plurality of apertures 32, 34 each aligned with a respective passage 28, 30 and spaced rearwardly of the respective mating face 24, 26.

Each hermaphroditic cover member 16, 18 has a housing engaging edge portion 35, 36 each including a plurality of tines 38, 40. Each tine 38, 40 is aligned to be received in a respective passage 28, 30 of the adjacent housing member 12, 14. Each cover member 16, 18 further includes, at one rear corner, a depending first latching leg 42, 44 having a shoulder 46, 48 directed towards the opposite housing engaging edge portion. The opposite rear corner of each cover member has a rear step 50, 52 which receives the shoulder 48, 46, respectively of the opposite cover member. On the side of each cover member, intermediate the front and rear edges, there is a second latching leg 54, 56 each with an inwardly directed shoulder 58, 60 positioned to engage in a side step 64, 62 on the opposite side of the opposing cover member. Each cover member is further provided with a pair of inwardly directed latching lugs 66, 68 adapted to engage the rear edge of the respective housing to form a subassembly of a housing and a cover member. Each cover member is further provided with a mounting leg 70, 72, on one side edge and a standoff abutment 74, 76 on the opposite side edge. The mounting legs 70, 72 are of sufficient length to extend beyond the respective mating faces 24, 26 of the housings while the abutments 74, 76 are substantially coplanar with the mating faces.

Each terminal 20 includes a forward mating end which is formed as a cantilever beam 78. The terminal 20 further includes insulation displacing rear portion formed by a pair of upstanding walls 80, 82 defining a channel therebetween. Each end of each wall is inwardly directed with the opposing pairs of end portions defining insulation piercing slots therebetween. This portion of the terminal is fully described in application Ser. No. 927,720 filed July 25, 1978, and now abandoned the disclosure of which is incorporated herein by reference. Each terminal is further provided with a pair of conductor engaging ears 84, 86 and a mounting lance 88.

Figure 2:
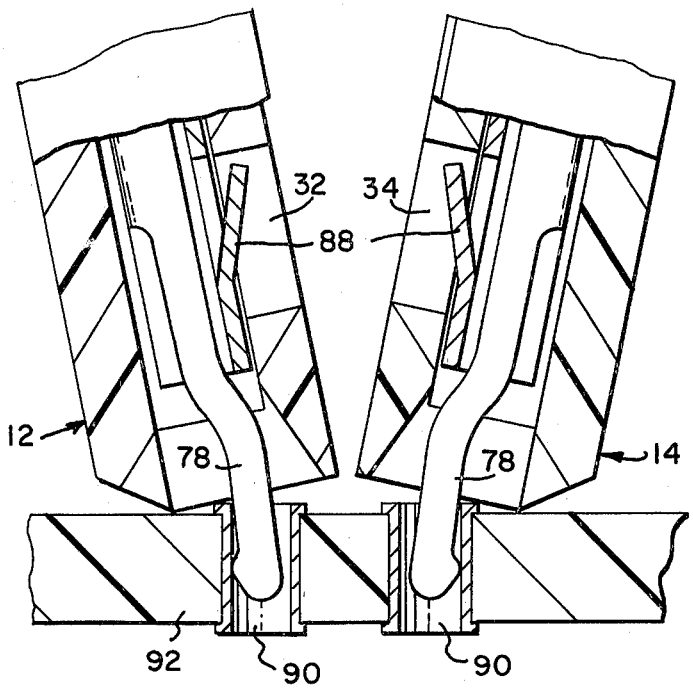
FIG. 2 is a detailed side elevation, partly in section, showing the initial engagement of the subject invention with a circuit board.
Figure 4:
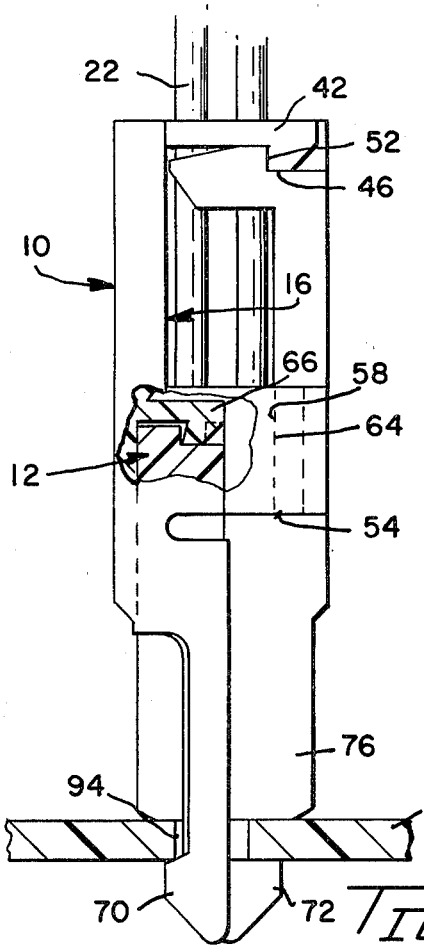
FIG. 4 is a side elevation, partially in section, of the assembled and mounted electrical connector according to the present invention.
Figure 3:
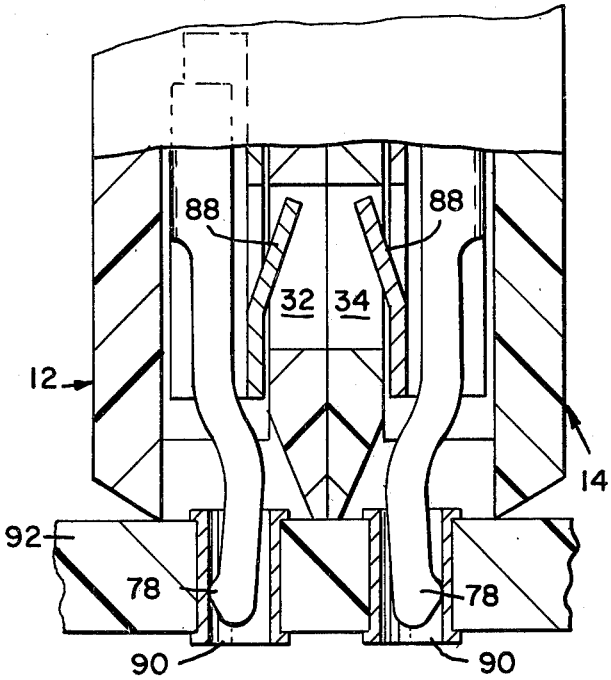
FIG. 3 is a detailed side view, partly in section, showing the subject invention in a fully engaged and mounted condition.

The subject housings 12, 14 are each preloaded with a plurality of terminals 20. Each terminal has its beam portion 78 extending from the respective mating face 24, 26 and the sidewalls 80, 82 of the insulation piercing portion lying in the open rear end of the respective passages 28, 30. The individual conductors 22 are terminated by the respective terminals in the manner described in the previously mentioned U.S. Pat. No. 4,243,288 and the cover members 16, 18 are then applied by placing the leading edges 35, 36 against the housings so that the tines 38, 40 enter into the passageways 28, 30. It will be noted from FIG. 4 that when the cover members are assembled with the respective housings, the lugs 66, 68 engage rear portions of the housings to form a subassembly. The thus formed subassemblies of the subject connector are then applied to the circuit board by first inserting the beams 78 of the respective terminals 20 into the conductive holes 90 of a circuit board 92. The holes 90 are preferably plated through holes but also could be holes lined with grommets or other like inserts (not shown). The respective subassemblies of the connector are then pivoted relative to one another, as seen in FIGS. 2 and 3 to bring the beams 78 into engagement with the walls of the holes 90 and to bring the cover members 16, 18 into a locking engagement, as shown in FIG. 4. It will also be noted from FIG. 4 that the mounting legs 70, 72 pass through mounting apertures 94 in the circuit board and secure the connector in position.

The present invention may be subject to many modifications and changes without departing from the spirit or essential characteristics thereof. The present embodiment should therefore be considered in all respects as illustrative and not restrictive of the scope of the invention.

What is claimed is:

1. An electrical connector assembly comprising:

a pair of identical elongated housing members of rigid insulative material each having a plurality of terminal passageways extending from a rear end through said housing members to open on a front mating face, each said passageway having a fully enclosed portion adjacent the mating face and an outwardly open channel shaped portion at the rear end remote from said mating face;

a like plurality of terminals each mounted in a respective one of said passageways, each terminal having a forwardly directed cantilever beam extending from said mating face and an insulation displacing conductor engaging rear end portion lying in and accessible from said channel shaped portion; and a pair of hermaphroditic cover members each having means engaging a respective one of said housing members to form a subassembly, latching means detachably securing said cover members together, and mounting legs receivable in mounting apertures in a circuit board whereby said subassemblies are initially individually engaged with an angular orientation to a circuit board with the beams of the terminals extending into but not contacting conductive holes in the circuit board and the subassemblies rotated with respect to one another and the circuit board to bring said cover members into locking engagement while bringing the beams into engagement with the walls of said conductive holes.

2. An electrical connector assembly according to claim 1 wherein each said housing member further comprises:

a plurality of apertures in said fully enclosed portion of each said housing member, each said aperture opening into a respective passageway; and each said terminal has a latching tine adapted to engage in a respective aperture.

3. An electrical connector assembly according to claim 1 wherein each said insulation displacing portion of each said terminal comprises:

a pair of parallel spaced sidewalls defining a channel therebetween; and end portions of at least one end of each said sidewalls being turned inwardly towards each other to define a conductor engaging slot therebetween.

4. An electrical connector assembly according to claim 1 wherein each said terminal further comprises:

a pair of crimp ears integral with said terminal and adapted to crimpingly engage a respective conductor to provide strain relief therefore.

5. An electrical connector assembly according to claim 1 wherein said means on each said cover member for engaging a respective one of said housing members comprises:

a forward edge having a plurality of tines extending therefrom spaced to be received in respective passageways of the associated housing members, and lug means spaced rearwardly of said forward edge adapted to releasably engage a rear portion of said associated housing member.

6. An electrical connector assembly according to claim 1 wherein said latching means on each said cover member comprises:

a leg depending from one rear corner of each said cover member and a step formed in an opposite rear corner of each said cover member, said leg engaging a respective step in a mating condition of said cover members to detachably secure said subassemblies together.

7. An electrical connector assembly according to claim 1 wherein said latching means on each said cover member includes:

first set of interengaging steps and legs at opposite rear corners of said cover members, and a second set of interengaging steps and legs on opposite sides of said cover members intermediate said front and rear ends thereof.

8. In combination with a printed circuit board having an array of conductive holes, an electrical connector assembly for making zero insertion force connection with said circuit board, said electrical connector assembly comprising:

a pair of identical elongated housing members of rigid insulative material each having a plurality of terminal passageways extending from a rear end through said housing member to open on a front mating face, each said passageway being fully enclosed adjacent the mating face and outwardly open to form a channel shape at the rear end remote from said mating face;

a like plurality of terminals each mounted in a respective one of said passageways, each terminal having a forwardly directed cantilever beam extending from said mating face and an insulation displacing conductor engaging rear end portion lying in and accessible from said channel shape at said rear end; and a pair of hermaphroditic cover members each having means engaging a respective one of said housing members to form a subassembly, latching means detachably securing said cover members together, and mounting legs receivable in mounting apertures in said circuit board whereby said subassemblies are initially individually engaged at a tilted angle with respect to the plane of said circuit board with the beams of the terminals extending into said conductive holes making only incidental contact therewith and the subassemblies rotated with respect to one another and to said circuit board to bring said cover members into locking engagement while bringing the beams into engagement with the walls of the respective conductive holes.

* * * * *